United States Patent [19]

Lindsay

[11] Patent Number: 4,585,090

[45] Date of Patent: Apr. 29, 1986

[54] ISOTROPHIC LOUDSPEAKER

[76] Inventor: Scott Lindsay, 34 Fishermill Rd., Cambridge, Ontario, Canada, N3C 1C7

[21] Appl. No.: 753,106

[22] Filed: Jul. 9, 1985

[51] Int. Cl.[4] ..... G10K 13/00; H04R 7/00

[52] U.S. Cl. ..... 181/163; 181/148; 181/171; 181/173

[58] Field of Search ..... 181/161-165, 181/148, 173, 171

[56] References Cited

U.S. PATENT DOCUMENTS

| | | | |
|---|---|---|---|
| 4,010,821 | 3/1977 | Quillmann | 181/148 |
| 4,147,229 | 4/1979 | Flashman | 181/148 X |
| 4,168,762 | 9/1979 | Griffin, Jr. | 181/148 X |

*Primary Examiner*—Benjamin R. Fuller
*Attorney, Agent, or Firm*—Richard J. Hicks

[57] ABSTRACT

An acoustic device in the form of a loudspeaker is described. An envelope consisting of many discrete parts is driven by an internal driven element so that the parts of the envelope move alternately in unison in an outwards direction and in unison in an inwards direction. Inside the envelope is arranged a framework comprising struts and tensile members, and the envelope parts are mounted on these struts and tensile members. Operation of the driven element varies the distance between two parallel struts of the framework. The framework is thus caused to distort and so cause the desired movement of the envelope parts. The single internal driven element can be replaced with two or more such elements in a modified arrangement.

7 Claims, 13 Drawing Figures

| | A1 | A2 | B1 | B2 | C1 | C2 | D1 | D2 | E1 | E2 | F1 | F2 |
|---|---|---|---|---|---|---|---|---|---|---|---|---|
| A1 | — | — | — | — | 1 | — | 2 | — | 3 | 4 | — | — |
| A2 | — | — | — | — | 5 | — | 6 | — | — | — | 7 | 8 |
| B1 | — | — | — | — | — | 9 | — | 10 | 11 | 12 | — | — |
| B2 | — | — | — | — | — | 13 | — | 14 | — | — | 15 | 16 |
| C1 | 1 | 5 | — | — | — | — | — | — | 17 | — | 18 | — |
| C2 | — | — | 9 | 13 | — | — | — | — | 19 | — | 20 | — |
| D1 | 2 | 6 | — | — | — | — | — | — | — | 21 | — | 22 |
| D2 | — | — | 10 | 14 | — | — | — | — | — | 23 | — | 24 |
| E1 | 3 | — | 11 | — | 17 | 19 | — | — | — | — | — | — |
| E2 | 4 | — | 12 | — | — | — | 21 | 23 | — | — | — | — |
| F1 | — | 7 | — | 15 | 18 | 20 | — | — | — | — | — | — |
| F2 | — | 8 | — | 16 | — | — | 22 | 24 | — | — | — | — |

ISOTROPHIC LOUDSPEAKER

FIELD OF THE INVENTION

This invention relates to acoustic devices, which when driven emit atmospheric pressure waves. Necessarily such an acoustic device includes a mobile element which is driven to move mechanically and thus directly or through associated parts to act on the adjacent air to produce pressure waves.

BACKGROUND OF THE INVENTION

In the case of "headphones", the mobile element may be a flat disc or diaphragm made of such material that it can be moved mechanically by adjacent electro-magnetic coils arranged to be energised by a fluctuating electrical current.

In the case of "loudspeakers", the mobile element usually is a cone-shaped element having corrugations extending from its wider end so that, despite the fact that this end of the cone is mounted on a rigid metal frame, the cone as a whole is free to move vibrationally in the direction of its axis. The smaller end of the cone is usually located against transverse movement by a "spider" which also permits free axial movement of the cone. This end of the cone also carries a cylindrical former on which is wound a "voice coil", arranged to float axial in an annular space between magnetic pole pieces. When a fluctuating electrical current is applied to the voice coil, the cone as a whole is driven vibrationally in an axial direction. The cone acts on the surrounding atmosphere to produce pressure waves which create the sensation of sound.

Whatever the form of the mobile element used in a transducer, necessarily as it moves in one direction to produce a pressure wave, it will produce a rarification on the opposite side of the element. This can be considered as the generation of two pressure waves, one 180 degrees out of phase with the other. It will be seen that the two pressure waves tend to interact with one another. One solution to this problem is to provide a baffle plate of sufficient area, and formed with an aperture which is filled by the mobile element. A baffle plate some 8 feet square will effectively supress interference between the two waves. One alternative is to provide some form of reflex enclosure, which has a sound path from the rear of the mobile element to a port directed in the same direction as the front of the mobile element. If that sound path delays the reverse wave by half a cycle, what emits from the port is in phase with the forward wave. There is of course the practical difficulty that the required length of the sound path is different for different frequencies of sound. A third known approach is to provide a sound absorbing or damping enclosure about the rear end of the mobile element. In that arrangement, the reverse wave is absorbed.

The acoustic device of the present invention is clearly distinct from such prior proposals, and does not make use of any baffle, reflex enclosure or sound absorbing or damping enclosure.

BRIEF STATEMENT OF INVENTION

According to the present invention, an acoustic device comprises electro-mechanical transducer means arranged to convert a fluctuating input electrical signal into vibratory mechanical movement of a driven element, an envelope substantially completely enclosing a volume of air, and coupling means by which the driven element is so coupled to the envelope that vibratory movement of the driven element causes substantially all parts of the envelope to move alternately in unison in an outwards direction and in unison in an inwards direction in a vibratory manner and so produce atmospheric pressure waves.

BRIEF DESCRIPTION OF DRAWINGS

The invention will now be described, by way of example, with reference to the accompanying drawings, in which.

DETAILED DESCRIPTION OF PREFERRED EMBODIMENTS

Figures 1, 2:
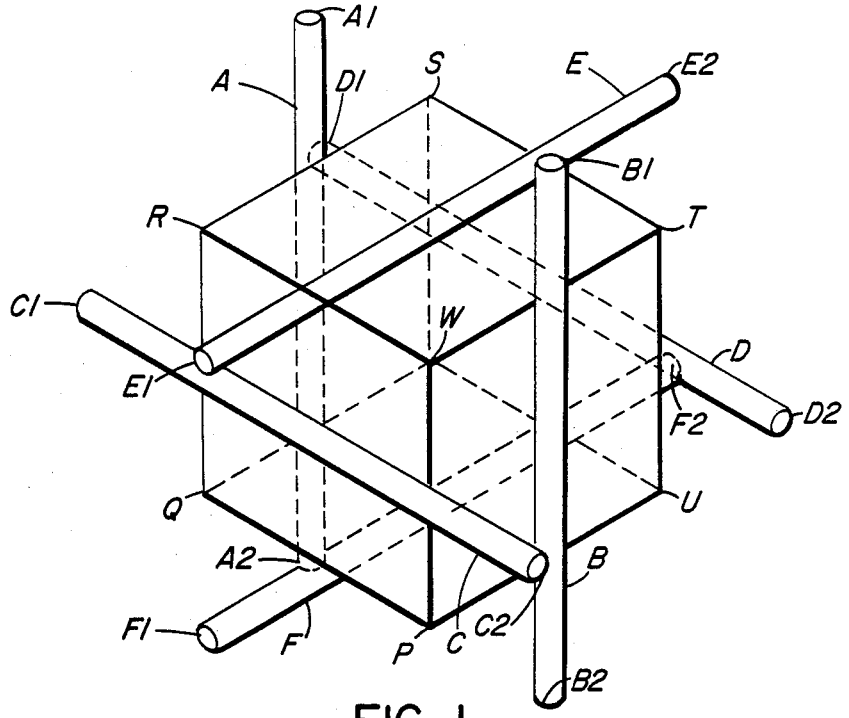
FIG. 1 relates to a first embodiment of the invention and is a diagram showing the spatial arrangement of six struts in an acoustic device.
FIG. 2 is a table showing the interconnection of end parts of the various struts.

FIG. 1 is a diagram intended to clarify the spatial arrangement of six struts A, B, C, D, E, and F. Each strut is in the form of a wooden rod of circular cross section with a diameter of $\frac{3}{8}$ inch, and is 18 inches long. The two ends of each strut are denoted respectively by the suffixes A and B. Thus strut A has two ends denoted respectively by A1 and A2. This figure includes a representation of a cube P,Q,R,S,T,U side of half the length of the struts, i.e. of 9 inches. The sole function of this cube is to assist the reader in visualising the spatial arrangement of the struts. It is not part of the structure of the acoustic device. Strut A is parallel to strut B, and the two struts are shown as lying on opposite faces of the cube. Strut C is parallel to strut D, and the two struts are shown as lying in opposite faces of the cube, and extending in a direction at right-angles to the struts A and B. Strut E is parallel to strut F and the two struts are showing as lying in opposite faces of the cube, and extending in a direction at right angles both to struts A and B and to struts C and D. The perpendicular spacing between the two struts in each pair is thus equal to the length of the cube side. The ends of the struts are selectively connected together by tensile members allocated the numerals T1 through T24. The table of FIG. 2 indicates this selective connection between strut ends. For example, strut end A1 is connected respectively by tensile members T1, T2, T3 and T4 to strut ends C1, D1, E1 and E2.

Figure 3:
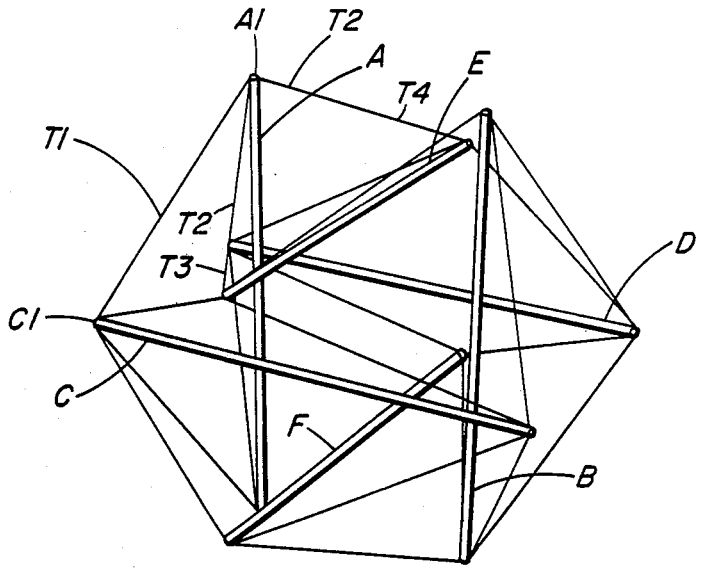
FIG. 3 is a pictorial representation of a complete framework to which FIGS. 1 and 2 refer.

Referring now to FIG. 3, this shows the appearance of the framework comprising the struts and the tensile members. The framework has the characteristic that, if the transverse spacing between any two parallel struts is modified, the whole framework undergoes symmetrical modification (if unrestrained) to accomodate the displacement. This effect is limited by the dimensions and materials used for the struts and the tensile members, and typically would not exceed a ten percent change in the transverse spacing of the parallel struts.

Figure 4:
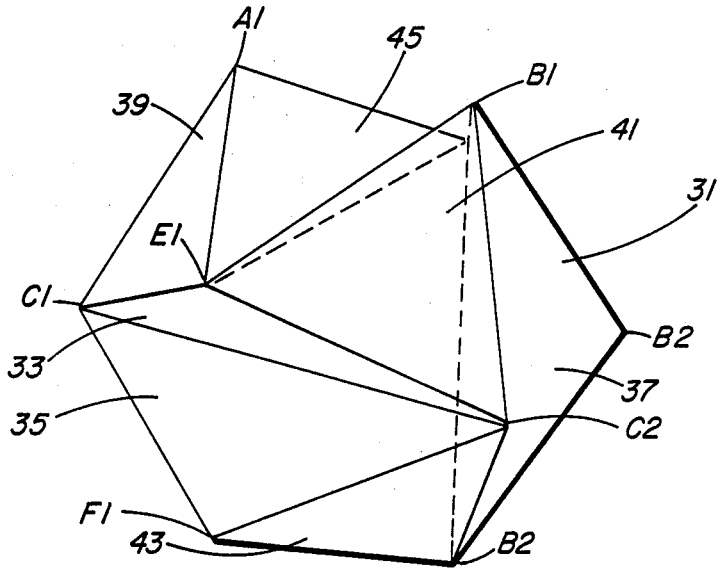
FIG. 4 is a pictorial view of the complete acoustic device.

FIG. 4 shows the external appearance of the complete acoustic device. An envelope 31 consisting the triangular panels, such as the panels 33, 35, 37, 39, 41, 43 and 45 are secured by means of adhesive along their edges to the tensile members and to the struts A through F. It will be seen that those triangular panels which have one edge secured to one of the struts help to define re-entrant parts of the envelope. For example, each of panels 33 and 35 is secured along one edge to the strut C, and these two panels define a re-entrant part of the envelope. On the other hand, each of the panels 39, 41 and 43 engages at each of its three corners the end of the struts, and thus defines a plane of the corners of which are equidistant from a centre point of the envelope.

Figure 5:
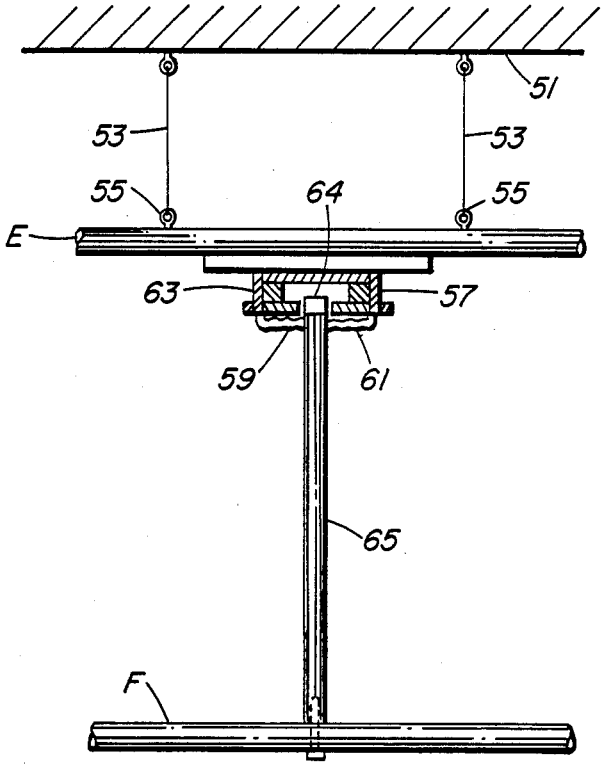
FIG. 5 is a side elevation, partly in section, showing the suspension and driving means of the acoustic device.

Referring now to FIG. 5, the acoustic device is suspended from a beam 51 by two flexible cords 53 attached at their lower ends to symetrically arranged points 55 on the strut E. Mounted on the underside of strut E is an electro-mechanical transducer 57. In the prototype illustrated, use was made of a standard 40 watt cone-type loudspeaker motor. Such a motor or unit comprises a pot-type permanent magnet unit 63, and a moving coil 64 mounted by two spider suspensions 59 and 61 so that the coil 64 is movable axially in an air gap between the poles of the magnet unit, but is positioned laterally. In this embodiment of the present invention, the magnet unit 63 is fixed to the strut E, and a driver element 65 is secured at its upper end to the moving coil 64 and at its lower end is detachably fastened to the centre point of strut F. Thus when in the usual manner a suitable fluctuating current is applied to the moving coil 64, the consequent axial movement of the driver element 65 will cause an appropriate vibratory change in the distance between struts E and F. It will be appreciated that the travel of the driver element 65, and thus the change in the spacing of the two struts E and F, will be only a small fraction of an inch.

Figure 6:
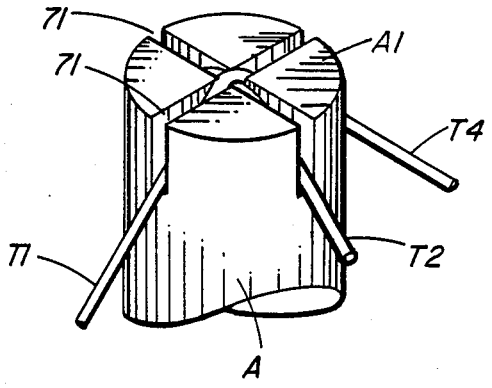
FIG. 6 is a pictorial representation of one end of a strut showing the arrangement of the associated tensile members.

During assembly of the acoustic device shown in FIGS. 1 through 6, the six struts can first be clamped to a cubical framework built up from metal angle sections bolted together. This enables the six struts to be held in the desired spatial relationship while the tension members are fitted in place. A single length of nylon fishing line or cord with a diameter of $\frac{1}{8}$ can be used for the tensile members. One end of the cord is attached to one strut end, and with a suitable pretension in the cord it can be fitted from strut end to strut end to satisfy the table of FIG. 2. FIG. 6 shows how each strut end is formed with two notches 71 to accommodate parts of this cord. The second end of the cord is then secured to the last of the strut ends. After a suitable checking of the tensions in the various tensile members, adhesive is applied to each notch to secure the parts of the cord in place. Finally, the 20 triangular panels 33 required for a 6 strut device are secured in place using a suitable adhesive. In the prototype device, the triangular panels were formed from blue styrofoam "SM", and a silicone adhesive was used to bond the panels to the tensile members and to the struts.

For some purposes it is desirable to provide a point source of sound, i.e. a sound source which would radiate the given sound equally in all directions. Thus if one could provide an active sound emitting surface in the form of the surface of a balloon, and if one could then cause that balloon to expand and contract repeatedly over a small range but at the desired frequency, one would have that desired point souce of sound. It is difficult to design an electro-mechanical driver which would transmit its motion equally to every point on the balloon surface.

The framework described above with reference to FIGS. 1 through 6 is what is called a spherical tensigrity. Each strut is held in place by the cooperative action of the 29 other parts of the framework. When one strut is diplaced relative to the others, the whole framework undergoes symmetrical modification (if unrestrained) to accommodate the displacement. Thus, if the distance between two of the parallel struts is modified, then for a limited range of values the system expands or contracts as a whole. The theory of such frameworks is studied in the book "Geodesic mathematics and how to use it" by Hugh Kenner, published 1976 by University of California Press in the U.S.A.

The six strut, 24 tensile member framework described above has several advantages. First, the stretch of the tensile members is small even with relatively large changes in the spacing of a pair of parallel struts. For example, a 1% change in strut spacing would cause a change in length of the tensile members of only 0.00166%. While a 10% change in strut spacing would cause a length change of 0.167% in the tensile members. Secondly, the framework "stiffens" as the spacing between a pair of parallel struts changes from the unstrained spacing of those members. This follows from the figures already given, since a tenfold increase in strut displacement from its equilibrium spacing (i.e. from 1% to 10%) sets up a hundredfold change in the stretch of the tensile members. Thus the restoring force on the framework increases rapidly with displacement. A third advantage of this particular framework is that the volume of the enclosure changes with a change in the spacing between parallel struts.

Thus, in an arrangement in which the strut length is 12 inches, the volume enclosed by the framework is 252 cubic inches, and the surface area is 294 square inches. For a change in separation between parallel struts of 0.1 inch, the change in volume is 22.2 cubic inches (i.e. 8.8%) while the change in surface area is 4.8 square inches (i.e. 1.6%). The ratio of change of surface to change in volume is thus 1/5.5.

Figure 7:
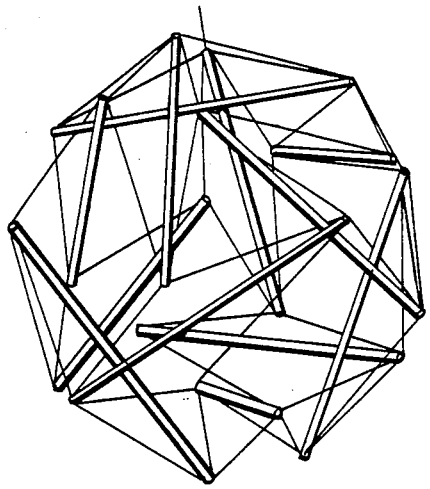
FIG. 7 is pictorial representation of a second embodiment of the invention and corresponds to FIG. 3 of the first embodiment of FIGS. 1 to 5.

A closer approximation to the ideal shape of a sphere for the envelope 31 can be obtained by using a framework containing more struts and more tensile members. Thus FIG. 7 illustrates an arrangement in which 12 struts are combined with 48 tensile members. Such a framework is also a spherical tensigrity, and is one of several such which can be derived mathematically in a manner described in the book referred to above.

In the embodiment of the invention described above with reference to FIGS. 1 through 6, the acoustic device is supported by cords secured to strut E, and the permanent magnet unit 63 which provides the drive for the acoustic device is carried by that strut. The moving coil associated with unit 63 is mounted on the driver element 65 which in turn drives strut F. In the third embodiment of the invention shown in FIG. 8, the acoustic device of FIGS. 1 through 5 is modified in that the driver element 65 is rigidly fixed to the supported strut E, the permanent magnet unit 63 is disposed at the lower end of the driver element 65, and the associated moving coil 64 is mounted directly on the lower strut F. A suitable varying current applied to the coil 64 will cause relative axial movement between the coil 64 and unit 63, and driver element 65 will serve to cyclically vary the distance between struts E and F.

Figure 8:
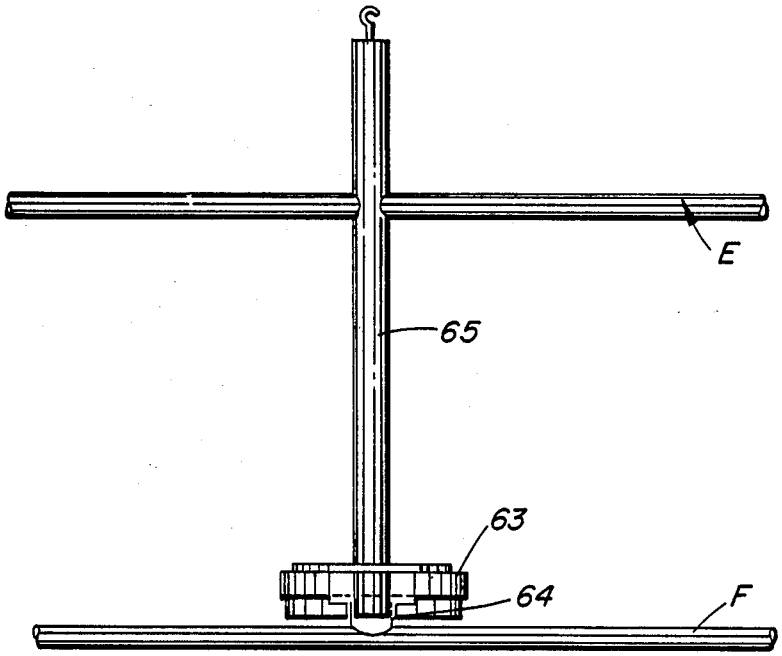
FIG. 8 relates to third embodiment of the invention, and corresponds to FIG. 5 of the first embodiment.
Figure 9:
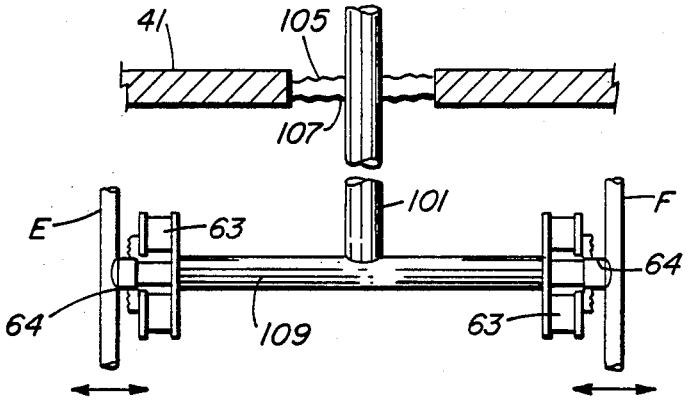
FIG. 9 relates to a fourth embodiment of the invention, is a sectional side elevation of suspension and driving means, and corresponds to FIG. 5 of the first embodiment.
Figure 10:
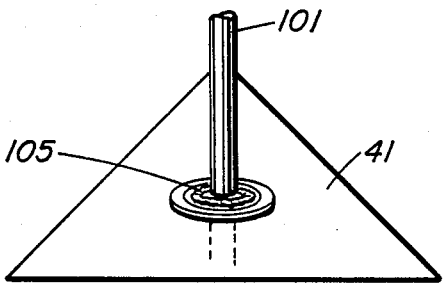
FIG. 10 is a fragmentary perspective drawing of part of the suspension means shown in FIG. 9.
Figure 11:
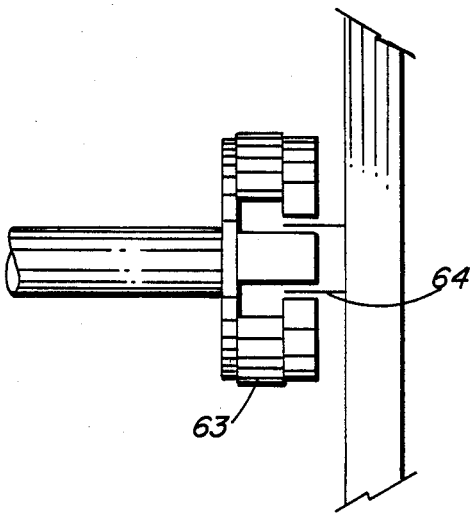
FIG. 11 relates to a fifth embodiment of the invention and is a sectional side elevation showing coupling of a driven element to an envelope panel.

The modification of the acoustic device of FIGS. 1 through 5 shown in FIG. 8 facilitates the use of more than one of the permanent magnet units 63, and thus facilitates the application of greater powers to the system of struts and tensile members. Thus in the fourth embodiment of FIGS. 9 and 10, the arrangement of FIGS. 1 through 5 is modified in that a support member 101 extends through a hole 103 in the panel 41 (which is shown in FIG. 4). Flexible spiders 105 and 107 maintain spacing between member 101 and the panel while permitting movement of the panel axially for the support member. In a central region of the acoustic device, a cross member 109 is mounted on member 101 and at each of its two ends carries a permanent magnet unit 63. These two units are associated respectively with moving coils 64 which are in turn mounted respectively on central parts of two parallel struts E and F. The two coils 64 are energised by the same or similar signals, i.e. in phase with one another. In this way, the displacements between the two parallel struts E and F are additive in causing movement of the parts of the acoustic device. In the modification of the acoustic device of FIGS. 1 through 5 shown in FIG. 11, use is made of the characteristic of the present invention, namely that the various pressure wave producing surfaces all move outwardly in unison, and then inwardly in unison. In the embodiment of FIG. 11, the driver element 65, which extends between two diametrically opposite panels, namely panel 41 and the opposite panel, carries at one end a permanent magnet unit 63 while the associated coil 64 is connected to a central point on the panel 41. If desired, the other end of driver element 65 could similarly be provided with a such a permanent magnet unit 63 and the associated panel then provided with a second coil 64.

Figure 12:
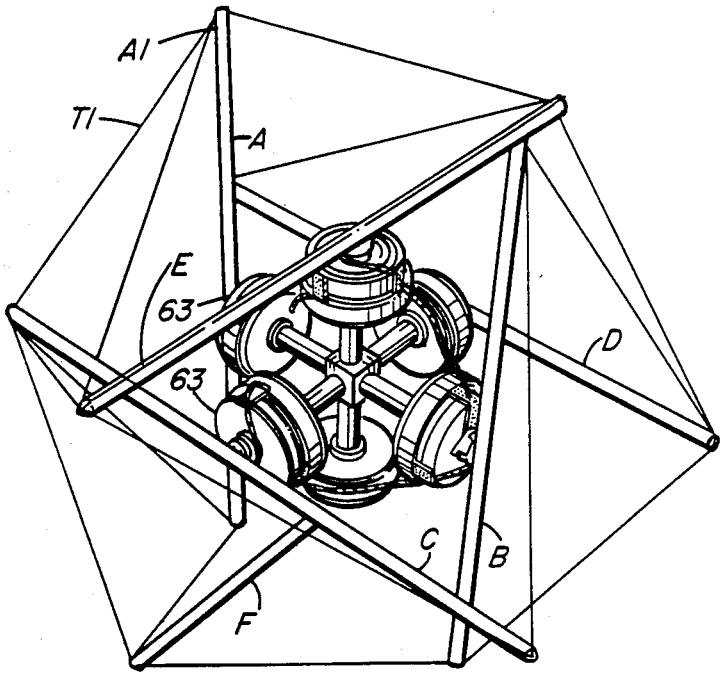
FIG. 12 is a pictorial view of a sixth embodiment of the invention, and shows an arrangement of struts, driver elements and tensile members.
Figure 13:
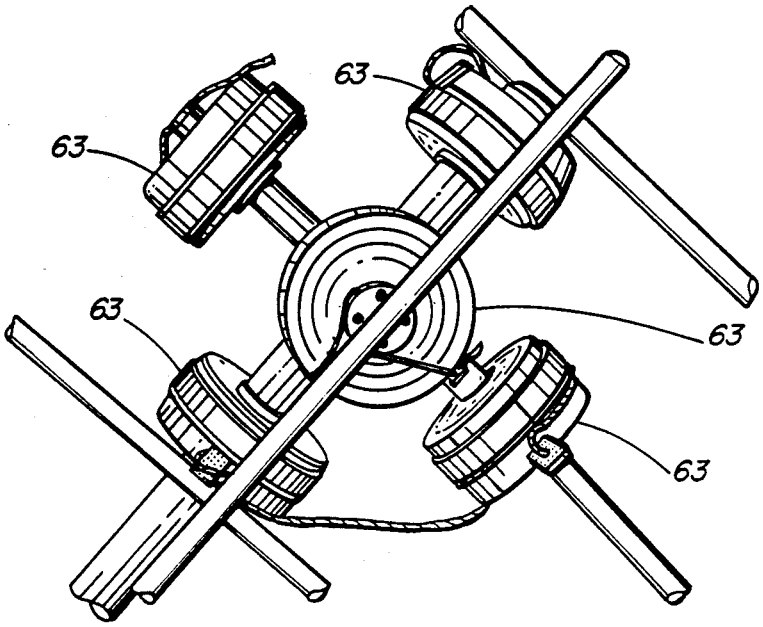
FIG. 13 is a view similar to FIG. 12 but taken from a different angle in order to show support means for the acoustic device.

A further modification of the arrangement shown in FIGS. 1 through 5 is shown in FIGS. 12 and 13. The struts and the tensile members are as shown in that first embodiment. However, three pairs of permanent magnet units 63 are provided, each associated with a coil 64. In this arrangement, a central block 121 is provided with six stubs designated respectively 123A, 123B, 123C, 123D, 123E and 123F, which extend respectively towards central portions of the struts A, B, D, E, E and F. Each stub carries at its outer end a permanent magnet unit 63 which cooperates with a coil 64 mounted on the central portion of the associated strut. The acoustic device is supported by a rod 131 connected to the central block 121 and extending out through one of the flat panels, provided with flexible spiders in the manner shown in FIGS. 9 and 10. In this embodiment, again all six coils 64 are simultaneously energised with equivalent signals to drive all parts of the acoustic device in unison.

I claim:

1. An acoustic device comprising electro-mechanical transducer means arranged to convert a fluctuating input electrical signal into vibratory mechanical movement of a driven element, an envelope substantially completely enclosing a volume of air, and coupling means by which the driven element is so coupled to the envelope that vibratory movement of the driven element causes substantially all parts of the envelope to move alternately in unison in an outwards direction and in unison in an inwards direction in a vibratory manner and so produce atmospheric pressure waves, wherein the envelope encloses a framework comprising struts and tensile members, the struts being selectively coupled at their ends by the tensile members, the transducer means act upon two parallel struts, one of which forms the driven element, to cause relative movement between those two struts in a direction transverse to the lengths of the two struts, and the envelope comprises a number of emitter elements selectively mounted along their edges on the tensile members and the struts.

2. An acoustic device as claimed in claim 1, wherein the struts consist of a first pair of parallel spaced struts, a second pair of parallel spaced struts extending in a direction at right angles to the first pair, and a third pair of spaced struts extending in a direction at right angles to both the first and the second pairs of struts.

3. An acoustic device as claimed in claim 1, wherein the struts consist of a first pair of parallel spaced struts, a second pair of parallel spaced struts extending in a direction at right angles to the first pair, and a third pair of spaced struts extending in a direction at right angles to both the first and the second pairs of struts, and the tensile members are twenty-four in number, each end of each strut being coupled by four tensile members respectively to adjacent ends of other struts.

4. An acoustic device as claimed in claim 1, in which the emitter elements are in the form of light, rigid, triangular plates.

5. An acoustic device as claimed in claim 1, wherein the transducer means include first and second electromechanical transducers arranged coaxially and being located respectively adjacent the two parallel struts, whereby in operation the two transducers complement each other in causing said relative movement between those two struts.

6. An acoustic device as claimed in claim 1, wherein the envelope encloses a framework comprising struts and tensile members, the struts being selectively coupled at their ends by the tensile members, the struts consisting of a first pair of parallel spaced struts, a second pair of parallel spaced struts extending in a direction at right angles to the first pair, and a third pair of parallel spaced struts extending in a direction at right angles to both the first and the second pairs of struts, and the transducer means include first, second and third pairs of electro-mechanical transducers, which pairs are associated respectively with the three pairs of struts, in each pair the two transducers being located respectively adjacent the two parallel struts, whereby in operation the six transducers complement each other in producing said movement of all parts of the envelope.

7. An acoustic device as claimed in claim 1, wherein the envelope encloses a framework comprising struts and tensile members, the struts being selectively coupled at their ends by the tensile members, the envelope comprises a number of emitter elements selectively mounted along their edges on the tensile members and the struts, and the transducer means act upon two diametrically opposite emitter elements.

* * * * *